US010172479B2

(12) United States Patent
Horst et al.

(10) Patent No.: US 10,172,479 B2
(45) Date of Patent: Jan. 8, 2019

(54) COLLAPSIBLE PLAYPEN

(71) Applicant: Wonderland Nurserygoods Company Limited, Kwai Chung, N.T. (HK)

(72) Inventors: Andrew J. Horst, West Lawn, PA (US); Ryan N. Miller, Lancaster, PA (US); Curtis M. Hartenstine, Birdsboro, PA (US)

(73) Assignee: Wonderland Switzerland AG, Steinhausen (CH)

( * ) Notice: Subject to any disclaimer, the term of this patent is extended or adjusted under 35 U.S.C. 154(b) by 334 days.

(21) Appl. No.: 15/072,556

(22) Filed: Mar. 17, 2016

(65) Prior Publication Data

US 2016/0270557 A1 Sep. 22, 2016

Related U.S. Application Data

(60) Provisional application No. 62/176,899, filed on Mar. 18, 2015.

(51) Int. Cl.
*A47D 13/06* (2006.01)

(52) U.S. Cl.
CPC ..... *A47D 13/063* (2013.01)

(58) Field of Classification Search
CPC ..... A47D 13/00; A47D 13/06; A47D 13/061; A47D 13/063; A47D 13/065
See application file for complete search history.

(56) References Cited

U.S. PATENT DOCUMENTS 6,202,229 B1 * 3/2001 Cheng ..... A47D 7/002 403/100
2004/0045085 A1 * 3/2004 Yang ..... A47D 13/063 5/99.1

(Continued)

FOREIGN PATENT DOCUMENTS

CN 200966497 U 10/2007
CN 201320020 U 10/2009
CN 202739406 U 2/2013

OTHER PUBLICATIONS

Further Search Report from co-pending UK Patent Application No. 1604461.2 dated Dec. 16, 2016.

(Continued)

*Primary Examiner* — Eric J Kurilla
*Assistant Examiner* — Abigail R Hymel
(74) *Attorney, Agent, or Firm* — Daniel A. Tallitsch; Baker McKenzie LLP

(57) ABSTRACT

A collapsible playpen includes an upper frame assembly, four standing legs and a bottom linkage assembly. The upper frame assembly includes a first and a second side opposite to each other that respectively have a first and a second coupling bracket. The four standing legs have lower end portions respectively provided a plurality of foot members. A first and a second standing leg are respectively coupled with the upper frame assembly via a first and a second leg linkage that are assembled with the first coupling bracket, and a third and a fourth standing leg are respectively coupled with the upper frame assembly via a third and a fourth leg linkage that are assembled with the second coupling bracket. The bottom linkage assembly is connected with the foot members of the four standing legs.

28 Claims, 17 Drawing Sheets

(56) References Cited

U.S. PATENT DOCUMENTS

| | | | | |
|---|---|---|---|---|
| 2008/0000023 | A1* | 1/2008 | Chen | A47D 13/063 5/99.1 |
| 2009/0144896 | A1 | 6/2009 | Chen et al. | |
| 2013/0160205 | A1* | 6/2013 | Dowd | A47D 13/063 5/99.1 |
| 2013/0214574 | A1* | 8/2013 | Chapman | A47D 13/10 297/258.1 |
| 2015/0113728 | A1 | 4/2015 | Mountz | |

OTHER PUBLICATIONS

Search report of the co-pending UK Patent Application No. 1604461.2.

* cited by examiner

COLLAPSIBLE PLAYPEN

CROSS-REFERENCE TO RELATED APPLICATION(S)

This application claims priority to U.S. Provisional Application No. 62/176,899 filed on Mar. 18, 2015, the disclosure of which is entirely incorporated herein by reference.

BACKGROUND

1. Field of the Invention

The present invention relates to a collapsible playpen.

2. Description of the Related Art

The shapes of playpen frames have not significantly changed over the past years. Most playpen frames currently available on the market include four feet that are connected to vertical tubes, which are in turn connected with top rail corners. The top rail corners are connected with four top rails each of which being provided with a latch. Moreover, the feet are further connected to a center hub through multiple bar linkages.

Not only has the geometry remained constant, so has the folding and unfolding methods. To erect a traditional playpen, a caregiver must always first deploy the top rails and engage all the four latches on the top rails. Then the center hub can be engaged to erect the bottom half of the frame, which completes the unfolding sequence. To fold the frame, the aforementioned steps must be reversed: the center hub is first disengaged, which collapses the bottom half of the frame, and then each of the latches on the top rails can be disengaged for collapsing the top half of the frame. In other words, there are a specific folding sequence and a specific unfolding sequence that cannot be changed.

Therefore, there is a need for an improved playpen that is more convenient and flexible in use, and can address at least the foregoing issues.

SUMMARY

The present application describes a collapsible playpen for young children that can address the foregoing problems. In one embodiment, the collapsible playpen includes an upper frame assembly, four standing legs and a bottom linkage assembly. The upper frame assembly has four sides, which include a first and a second side opposite to each other that respectively have a first and a second coupling bracket, and a third and a fourth side opposite to each other that are respectively contiguous to the first and second sides. The four standing legs have lower end portions respectively provided a plurality of foot members, the four standing legs including a first and a second standing leg respectively coupled with the upper frame assembly via a first and a second leg linkage that are assembled with the first coupling bracket, and a third and a fourth standing leg respectively coupled with the upper frame assembly via a third and a fourth leg linkage that are assembled with the second coupling bracket. The bottom linkage assembly is connected with the foot members of the four standing legs.

In another embodiment, the collapsible playpen includes an upper frame assembly, four standing legs and a bottom linkage assembly. The upper frame assembly includes a first and a second frame subassembly that are respectively connected with a first and a second coupling bracket, the first frame subassembly having a first and a second end opposite to each other, and the second frame subassembly having a third and a fourth end opposite to each other. The four standing legs have lower ends respectively provided with foot members, the four standing legs including a first and a second standing leg respectively coupled with the first end of the first frame subassembly and the third end of the second frame subassembly via a first and a second leg linkage that are assembled with the first coupling bracket, and a third and a fourth standing leg respectively coupled with the second end of the first frame subassembly and the fourth end of the second frame subassembly via a third and a fourth leg linkage that are assembled with the second coupling bracket. The bottom linkage assembly is respectively connected with the foot members of the four standing legs. When the playpen is in an unfolded state, the first and second frame subassemblies form two cantilevers oppositely projecting from the first and second coupling brackets so as to respectively bias each of the first through fourth leg linkages to a geometric configuration for maintaining the unfolded state.

In yet another embodiment, the collapsible playpen includes a plurality of standing legs coupled with an upper frame assembly via a plurality of leg linkage assemblies, and a bottom linkage assembly connected with a plurality of foot members respectively provided at lower ends of the standing legs. The bottom linkage assembly includes a plurality of bar segments respectively connected pivotally with the foot members of the standing legs, a hub housing respectively connected pivotally with the bar segments, the bar segments having end portions received at least partially in the hub housing and being rotatable relative to the hub housing between a folded and an unfolded configuration, a handle having a guide slot and pivotally connected with the hub housing via a first pivot connection, a latch assembled with the hub housing for sliding movement, the latch contacting with the end portions of the bar segments at an upper side thereof to maintain the bar segments in the unfolded state, and a lever connected with the latch, the lever further being respectively connected pivotally with the hub housing and the handle via a second and a third pivot connection, the third pivot connection being guided for sliding displacement along the guide slot of the handle.

DETAILED DESCRIPTION OF THE EMBODIMENTS

Figure 1:
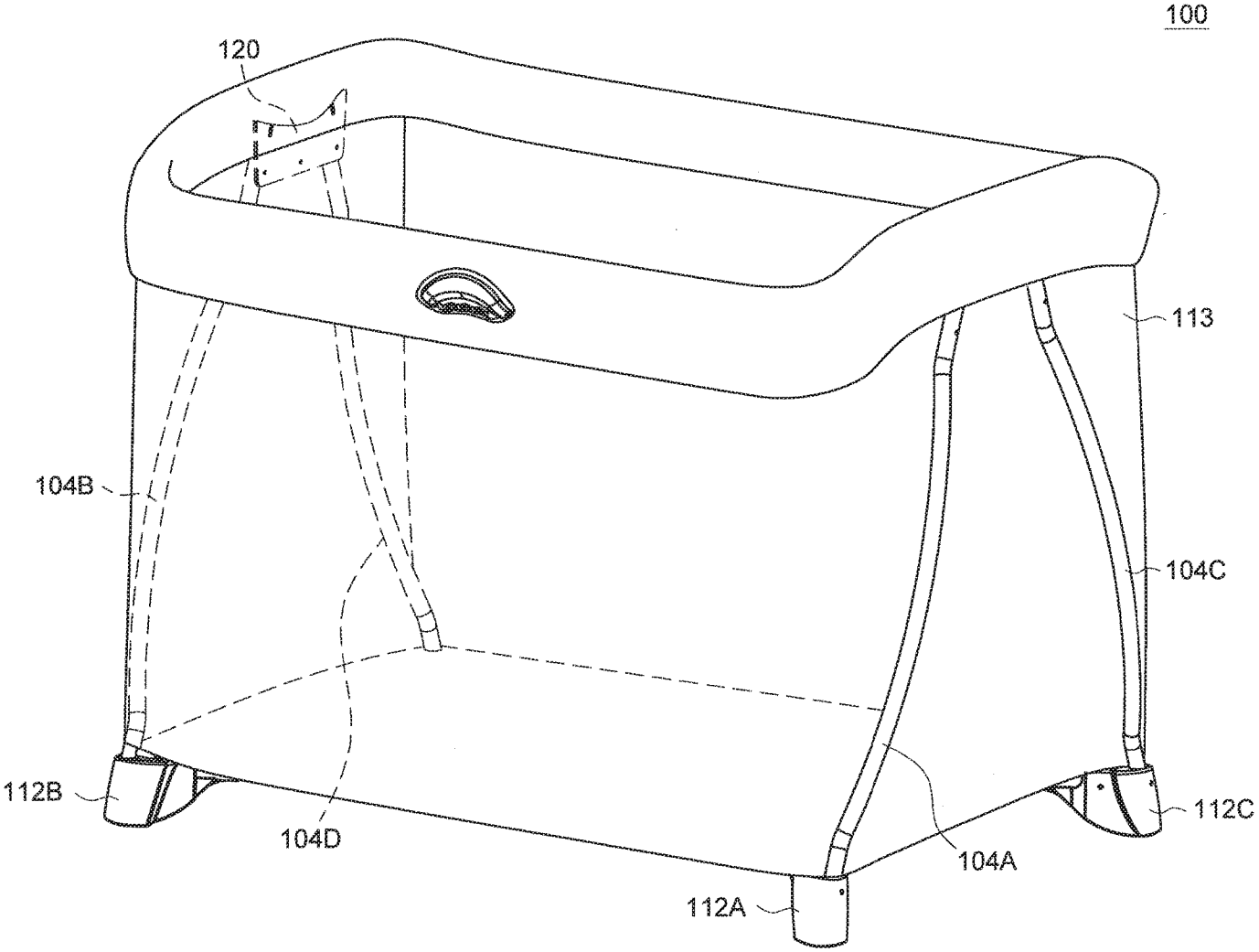
FIG. 1 is a perspective view illustrating one embodiment of an infant playpen.
Figure 2:
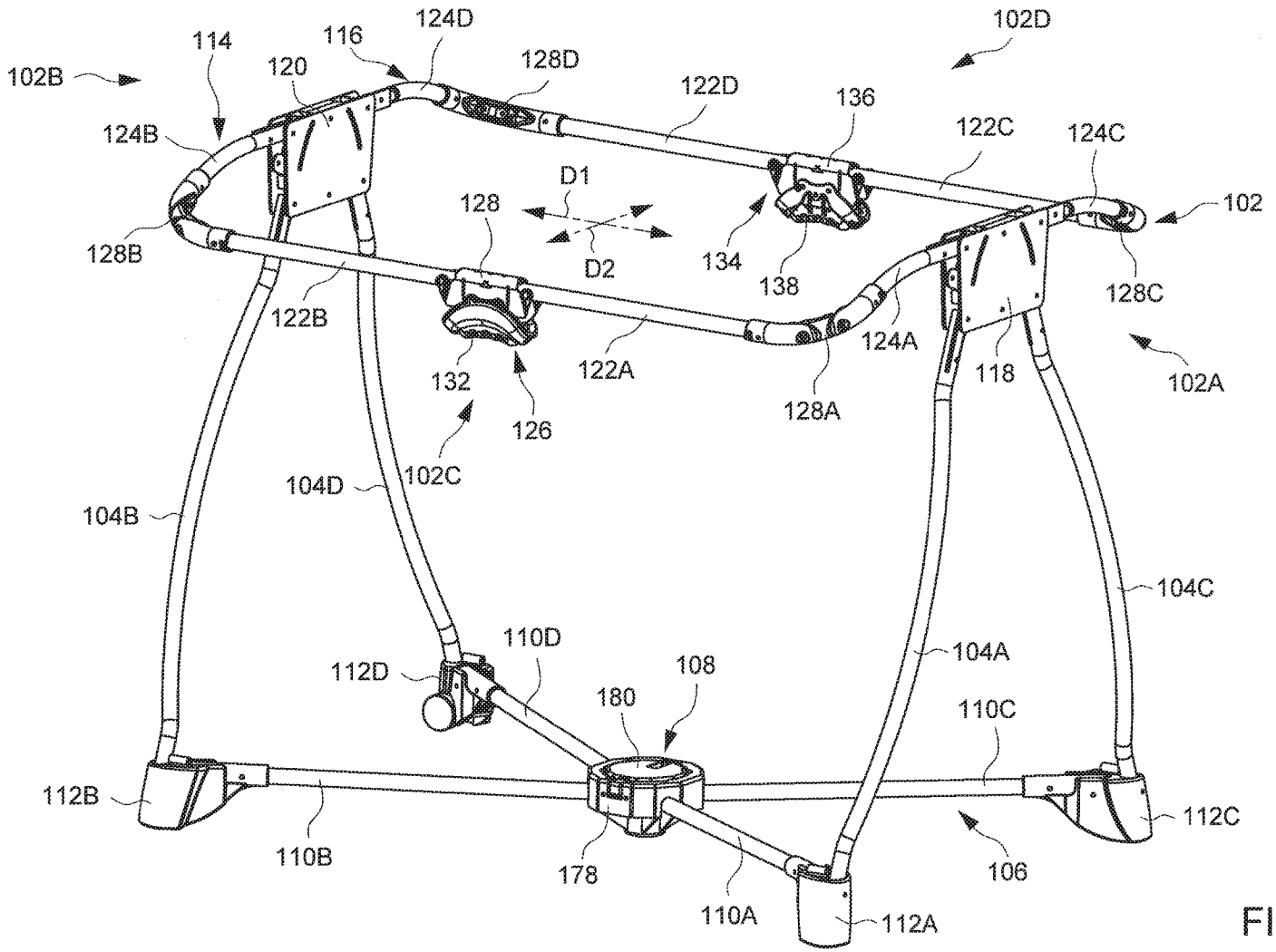
FIG. 2 is a schematic view illustrating the construction of a frame structure of the infant playpen shown in FIG. 1.
Figure 3:
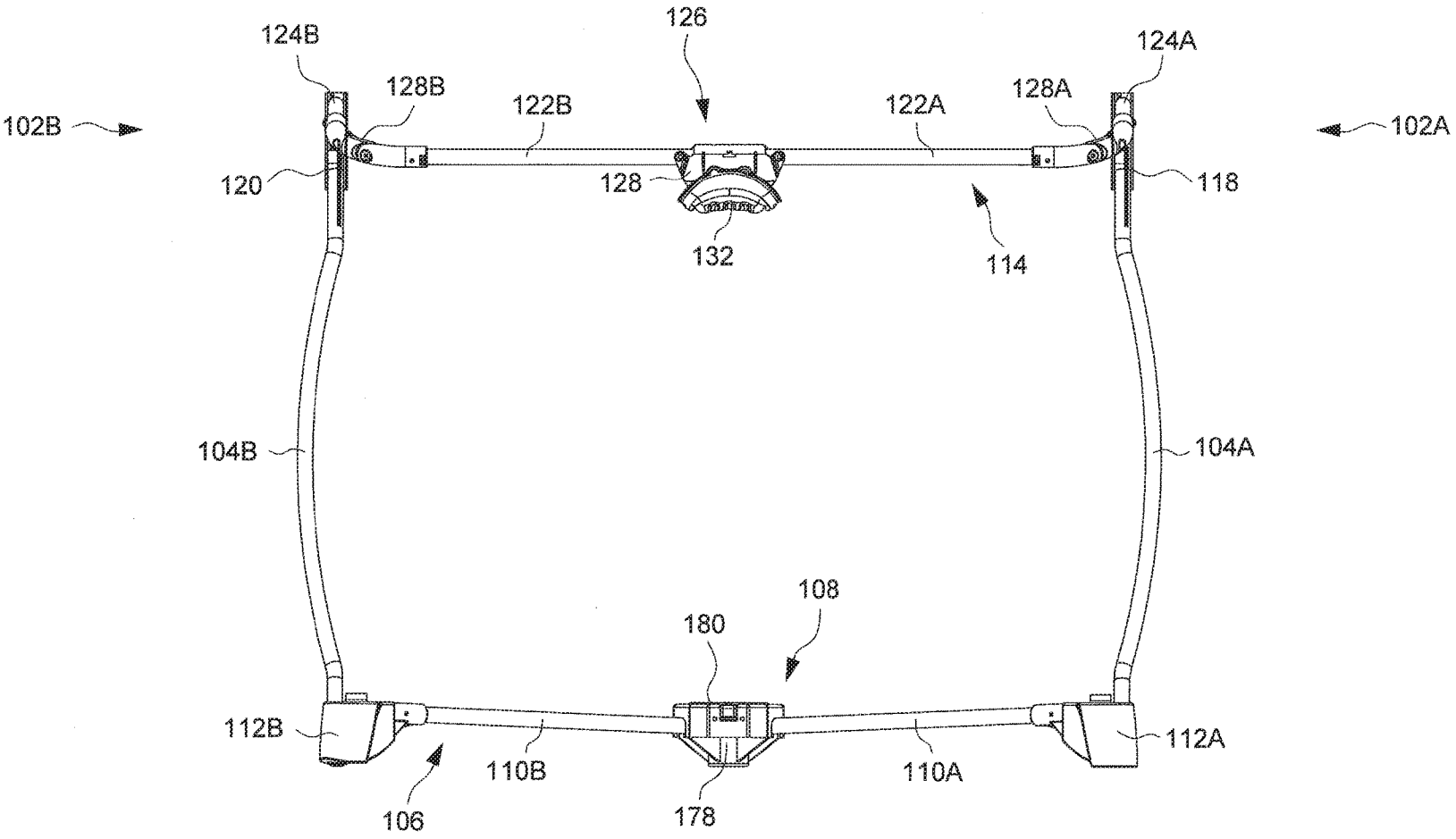
FIG. 3 is a schematic view illustrating a side of the frame structure shown in FIG. 2.
Figure 4:
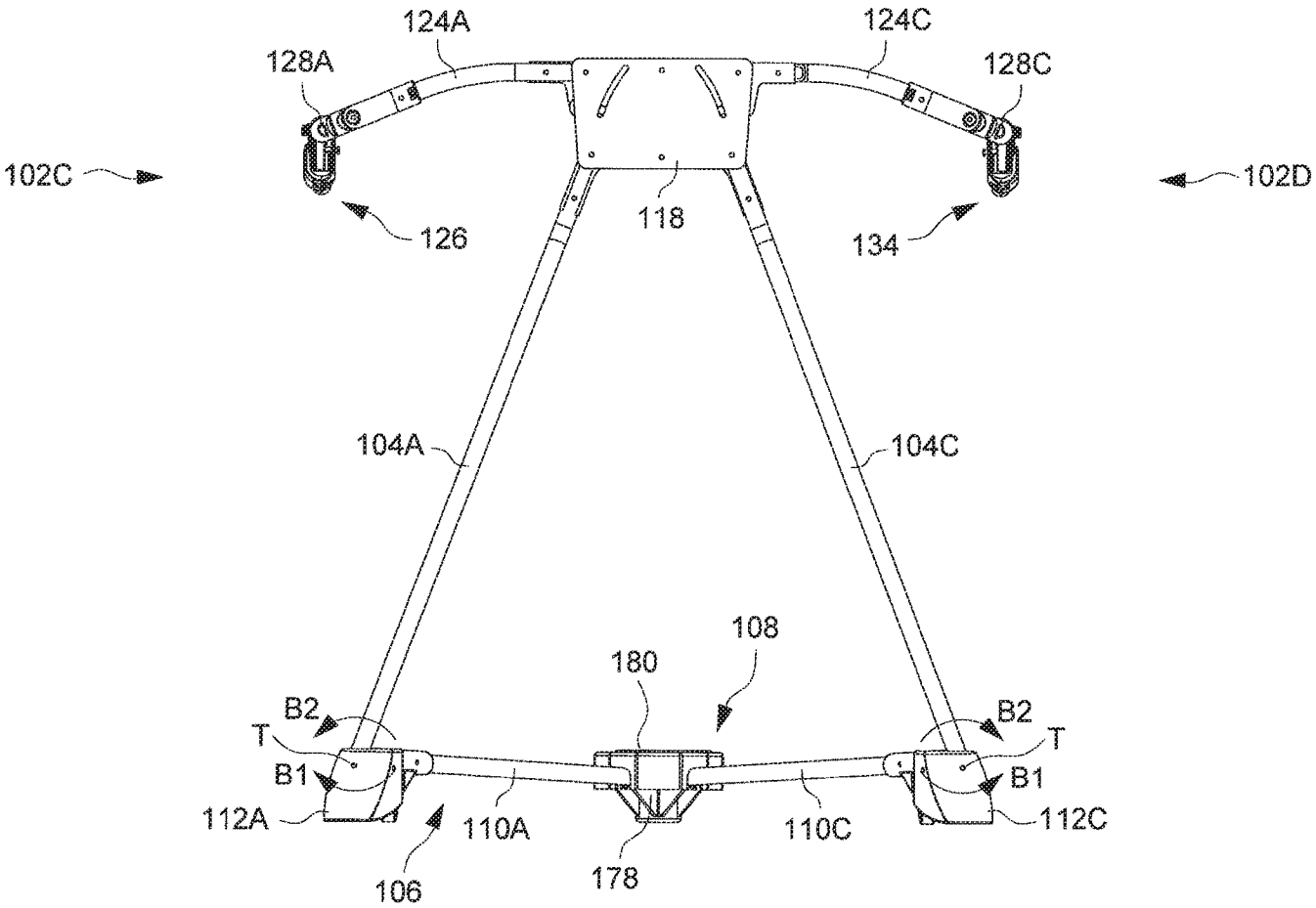
FIG. 4 is a schematic view illustrating another side of the frame structure contiguous to the side of FIG. 3
Figure 5:
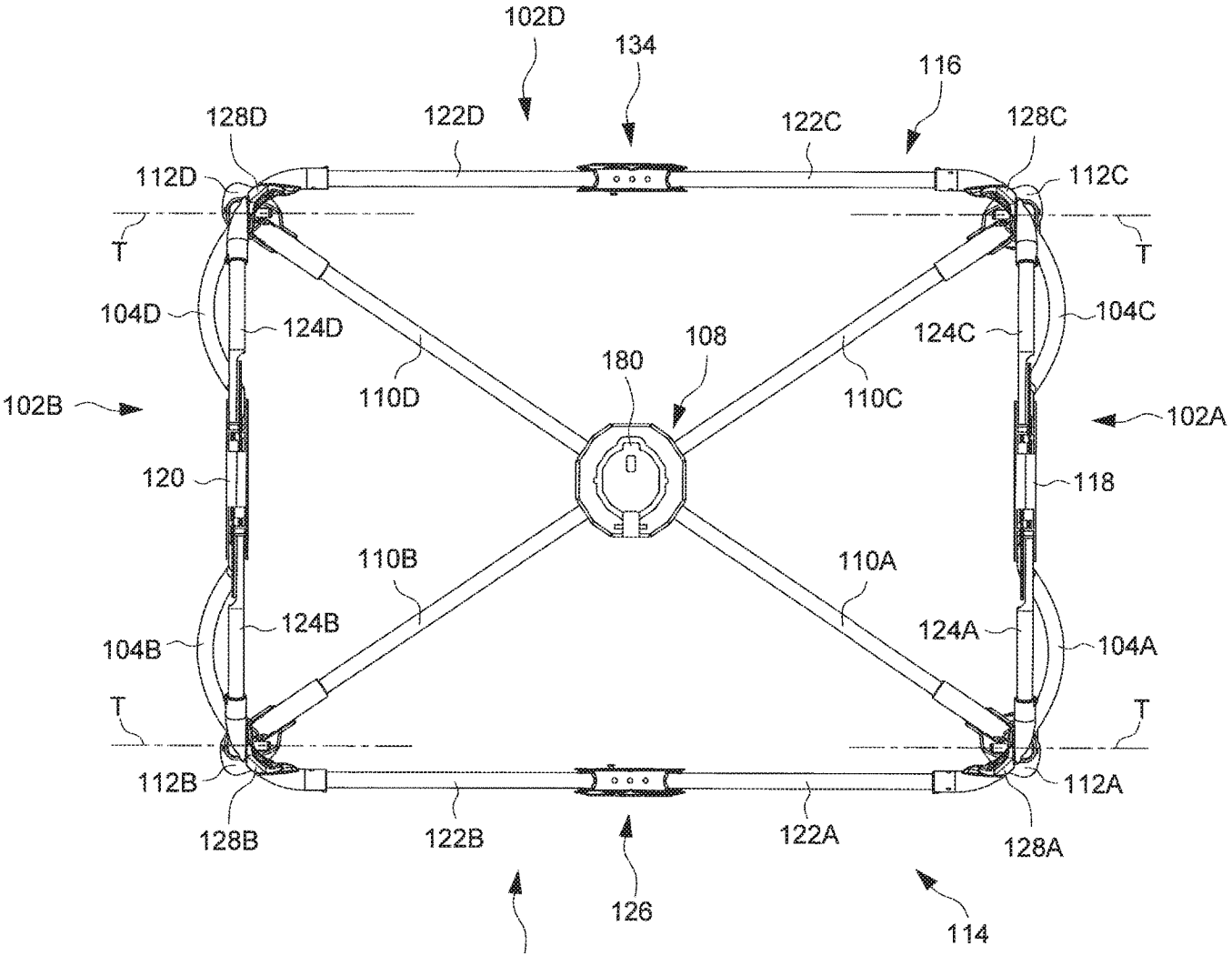
FIG. 5 is a top view of the frame structure shown in FIG. 2.

FIG. 1 is a schematic view illustrating an embodiment of a collapsible playpen 100, and FIGS. 2-5 are various views illustrating a rigid frame structure of the playpen 100. Referring to FIGS. 1-5, the playpen 100 can include an upper frame assembly 102, a plurality of (e.g., four) standing legs 104A, 104B, 104C and 104D, and a bottom linkage assembly 106. The upper frame assembly 102 can be coupled with upper end portions of the standing legs 104A, 104B, 104C and 104D. The bottom linkage assembly 106 can include a central hub 108, and a plurality of (e.g., four) bar segments 110A, 110B, 110C and 110D that are commonly connected pivotally with the central hub 108 and are further respectively connected pivotally with a plurality of foot members 112A, 112B, 112C and 112D provided at lower ends of the standing legs 104A, 104B, 104C and 104D. An enclosure 113 can be stretched between the standing legs 104A, 104B, 104C and 104D to surround an inner space of the playpen 100 where a young child can be received. The enclosure 113 can be formed by the assembly of one or more fabric, and can have an upper end secured with the upper frame assembly 102.

The upper frame assembly 102 can be formed by the assembly of multiple tube segments defining a closed shape. In one embodiment, the upper frame assembly 102 can include two frame subassemblies 114 and 116, and two coupling brackets 118, 120. Each of the two frame subassemblies 114 and 116 can have two opposite ends respectively connected pivotally with the two coupling brackets 118 and 120.

In one embodiment, the frame subassembly 114 can include two side segments 122A and 122B, two end segments 124A and 124B, a hinge 126 and two corner brackets 128A and 128B. The two side segments 122A and 122B can be coupled with each other via the hinge 126. The hinge 126 can exemplary have a housing 128, and two ends of the two side segments 122A and 122B can be respectively connected pivotally with the housing 128. The two end segments 124A and 124B can be respectively coupled with the two side segments 122A and 122B via the two corner brackets 128A and 128B that are disposed at two opposite sides of the hinge 126. More specifically, the corner bracket 128A can be respectively connected pivotally with one end of the side segment 122A and one end of the end segment 124A, and the corner bracket 128B can be respectively connected pivotally with one end of the side segment 122B and one end of the end segment 124B. The two ends of the end segments 124A and 124B opposite to the corner brackets 128A and 128B can be respectively connected pivotally with the coupling brackets 118 and 120.

The frame subassembly 114 can be operable to fold for convenient storage and unfold for use. When the frame subassembly 114 is in an unfolded configuration (as shown in FIGS. 1-5), it can have a generally U-shape in which the hinge 126 is disposed at a middle of the frame subassembly 114, the two side segments 122A and 122B extend generally along a direction D1, and the two end segments 124A and 124B extend substantially parallel to each other along another direction D2 generally perpendicular to the direction D1. Moreover, the hinge 126 can further include a latch mechanism (not shown) allowing the hinge 126 to lock the frame subassembly 114 in the unfolded configuration, and a release button 132 operable to unlock the hinge 126 for folding the frame subassembly 114. The latch mechanism incorporated in the hinge 126 may have any known constructions suitable to lock the two side segments 122A and 122B in an unfolded state.

Likewise, the frame subassembly 116 can include two side segments 122C and 122D, two end segments 124C and 124D, a hinge 134 and two corner brackets 128C and 128D. The two side segments 122C and 122D can be coupled with each other via the hinge 134. The hinge 134 can exemplary have a housing 136, and two ends of the two side segments 122C and 122D can be respectively connected pivotally with the housing 136. The two end segments 124C and 124D can be respectively coupled with the two side segments 122C and 122D via the two corner brackets 128C and 128D that are disposed at two opposite sides of the hinge 134. More specifically, the corner bracket 128C can be respectively connected pivotally with one end of the side segment 122C and one end of the end segment 124C, and the corner bracket 128D can be respectively connected pivotally with one end of the side segment 122D and one end of the end segment 124D. The two other ends of the end segments 124C and 124D opposite to those coupled with the corner brackets 128C and 128D can be respectively connected pivotally with the coupling brackets 118 and 120.

Similar to the frame subassembly 114, the frame subassembly 116 can be operable to fold for convenient storage and unfold for use. When the frame subassembly 116 is in an unfolded configuration, it can have a generally U-shape in which the hinge 134 is disposed at a middle of the frame subassembly 116, the two side segments 122C and 122D extend generally along the direction D1, and the two end segments 124C and 124D extend substantially parallel to each other along the direction D2. Moreover, the hinge 134 an further include a latch mechanism (not shown) allowing the hinge 134 to lock the frame subassembly 116 in the unfolded configuration, and a release button 138 operable to unlock the hinge 134 for folding the frame subassembly 116.

The upper frame assembly 102 described above can have four sides: two sides 102A and 102B opposite to each other that extend along the direction D2 respectively between the two corner brackets 128A and 128C and between the two corner brackets 128B and 128D, and two other sides 102C and 102D opposite to each other that are contiguous to the two sides 102A and 102B and extend along the other direction D1 respectively between the two corner brackets 128A and 128B and between the two corner brackets 128C and 128D. The two coupling brackets 118 and 120 can be respectively disposed at a middle of the two sides 102A and 102B of the upper frame assembly 102.

Referring again to FIGS. 1-5, the standing legs 104A and 104C can have upper end portions respectively connected pivotally with the coupling bracket 118, and lower end portions respectively provided with the foot members 112A and 112C. The foot members 112A and 112C may be respectively disposed below the corner brackets 128A and 128C, and the standing legs 104A and 104C can respectively converge from the foot members 112A and 112C toward the coupling bracket 118 so that the upper end portions of the standing legs 104A and 104C can respectively connect pivotally with the coupling bracket 118. Likewise, the standing legs 104B and 104D can have upper end portions respectively connected pivotally with the coupling bracket 120, and lower end portions respectively provided with foot members 112B and 112D. The foot members 112B and 112D may be respectively disposed below the corner brackets 128B and 128D, and the standing legs 104B and 104D can respectively converge from the foot members 112B and 112D toward the coupling bracket 120 so that the upper end portions of the standing legs 104B and 104D can respectively connect pivotally with the coupling bracket 120. As better shown in FIGS. 2, 3 and 5, the standing legs 104A, 104B, 104C and 104D can exemplary have curved profiles projecting outward relative to the inner space of the playpen 100. Owing to the convergent shape of the standing legs 104A, 104B, 104C and 104D, the corner regions of the playpen 100 between the upper frame assembly 102 and the foot members 112A, 112B, 112C and 112D can be substantially free of frame obstruction, which can result in wider unobstructed areas of the enclosure 113 on the two opposite sides of the playpen 100 corresponding to the sides 102C and 102D of the upper frame assembly 102.

Figure 6:
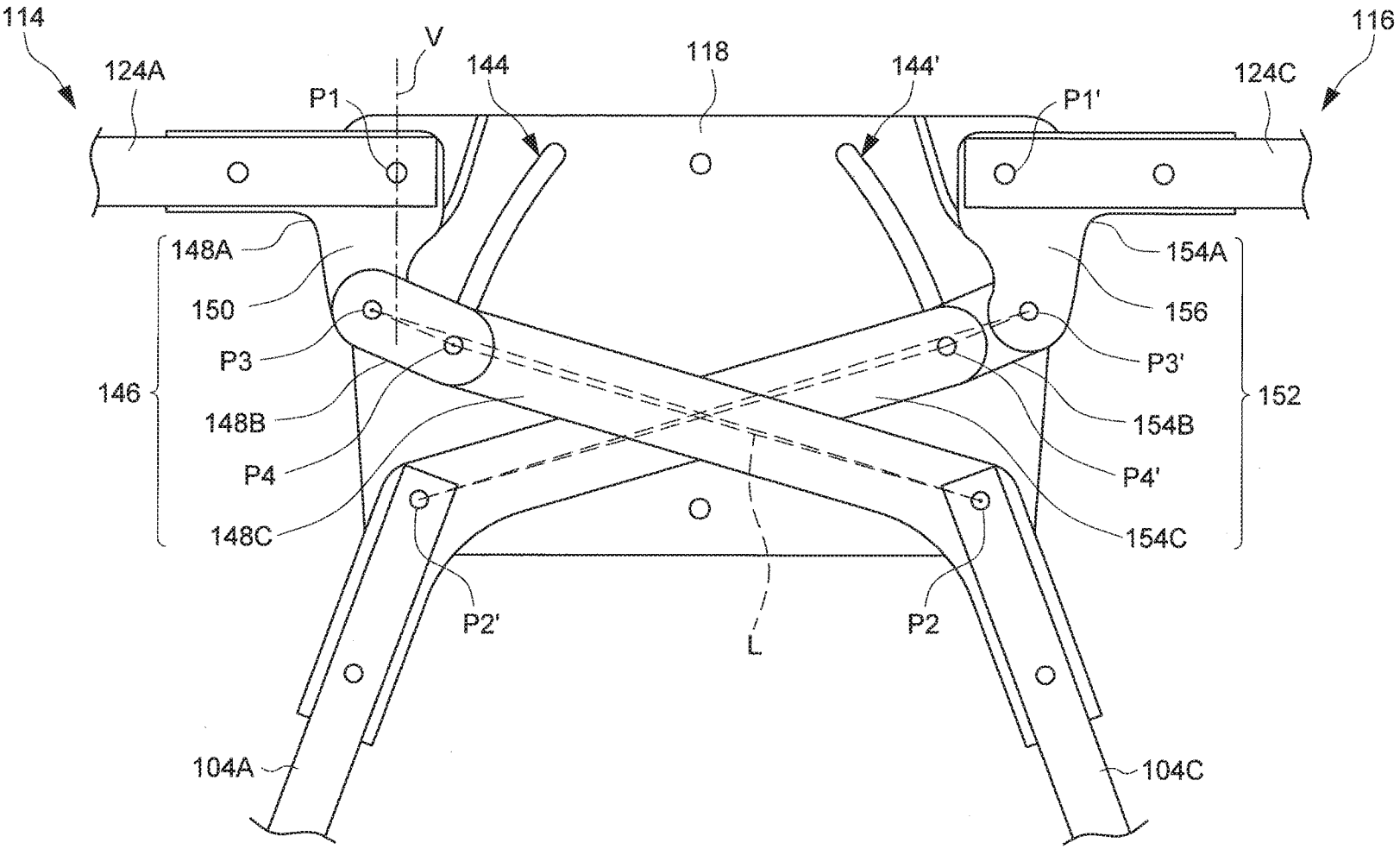
FIG. 6 is a schematic view illustrating the assembly of two leg linkages at a side of the frame structure shown in FIG. 2.

In conjunction with FIGS. 1-5, FIG. 6 is a schematic view illustrating the assembly of the coupling bracket 118 with the two frame subassemblies 114 and 116 and the two standing legs 104A and 104C on the side 102A. Referring to FIG. 6, the coupling bracket 118 can have two guide slots 144 and 144' disposed symmetric to each other, each of which having an elongated shape. Two end portions of the frame subassemblies 114 and 116 (i.e., respectively corresponding to end portions of the end segments 124A and 124C) can be respectively connected pivotally with the coupling bracket 118 via two pivot connections P1 and P1', and two upper end portions of the two standing legs 104A and 104C can be respectively connected pivotally with the coupling bracket 118 via two pivot connections P2' and P2. The two pivot connections P1 and P1' are arranged outside a region of the coupling bracket 118 located between the two guide slots 144 and 144', and the two pivot connections P2' and P2 are respectively disposed below the two pivot connections P1 and P1'.

The upper end portion of the standing leg 104C can be coupled with the end segment 124A of the frame subassembly 114 via a leg linkage 146, which is assembled with the coupling bracket 118 and can include three linking members 148A, 148B and 148C. The linking member 148A can be affixed with the frame subassembly 114 (in particular with the end segment 124A), and can have an ear 150 projecting eccentrically from the pivot connection P1. The linking member 148B can be connected with the ear 150 of the linking member 148A via a pivot connection P3. The linking member 148C can be affixed with the upper end portion of the standing leg 104C, and can be pivotally connected with the linking member 148B via a pivot connection P4 which is guided for sliding displacement along the guide slot 144.

Likewise, the upper end portion of the standing leg 104A can be coupled with the end segment 124C of the frame subassembly 116 via a leg linkage 152 that is assembled with the coupling bracket 118. The leg linkage 152 can be similar to the leg linkage 146 in structure, and can include three linking members 154A, 154B and 154C. The linking member 154A can be affixed with the frame subassembly 116 (in particular with the end segment 124C), and can have an ear 156 projecting eccentrically from the pivot connection P1'. The linking member 154B can be connected with the ear 156 of the linking member 154A via a pivot connection P3'. The linking member 154C can be affixed with the upper end portion of the standing leg 104A, and can be pivotally connected with the linking member 154B via a pivot connection P4' which is guided for sliding displacement along the guide slot 144'.

The aforementioned assembly of the two leg linkages 146 and 152, frame subassemblies 114 and 116, and standing legs 104A and 104C on the side 102A can have a symmetric geometry, the two leg linkages 146 and 152 forming a cross-shape. All of the pivot connections P1, P1', P2, P2', P3, P3', P4 and P4' can be achieved with any suitable parts such as pins or shaft portions, and can respectively define pivot axes that are parallel to one another along the direction D1.

Figure 7:
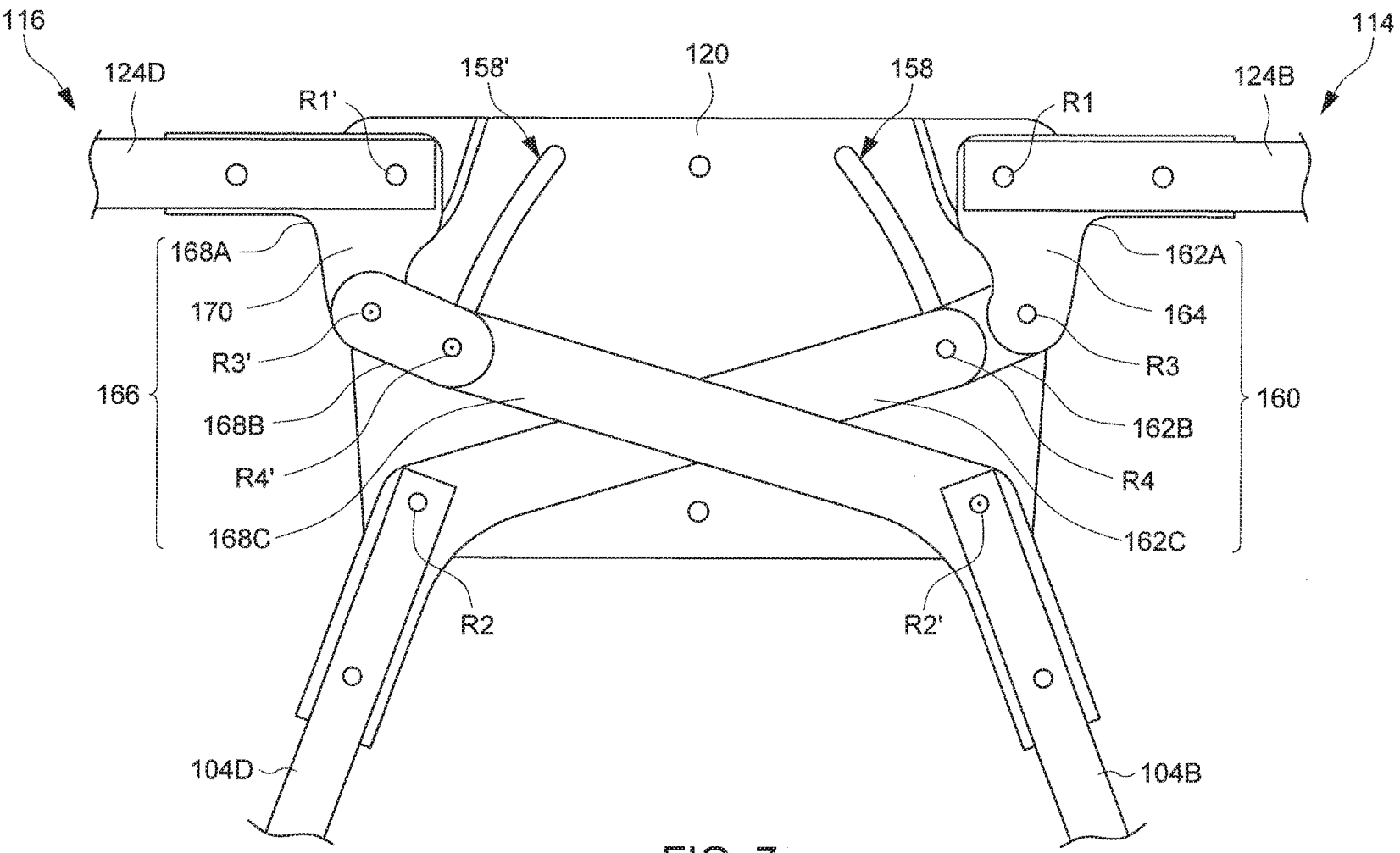
FIG. 7 is a schematic view illustrating the assembly of two other leg linkages at an opposite side to the side shown in FIG. 6.

FIG. 7 is a schematic view illustrating the assembly of the coupling bracket 120 with the two frame subassemblies 114 and 116 and the two standing legs 104B and 104D on the side 102B, which is similar to the assembly on the side 102A shown in FIG. 6. Referring to FIG. 7, the coupling bracket 120 can have two guide slots 158 and 158' disposed symmetric to each other, each of which having an elongated shape. Two end portions of the frame subassemblies 114 and 116 (i.e., respectively corresponding to end portions of the end segments 124B and 124D) can be respectively connected pivotally with the coupling bracket 120 via two pivot connections R1 and R1', and two upper end portions of the two standing legs 104B and 104D can be respectively connected pivotally with the coupling bracket 120 via two pivot connections R2' and R2. The two pivot connections R1 and R1' are arranged outside a region of the coupling bracket 120 located between the two guide slots 158 and 158', and the two pivot connections R2' and R2 are respectively disposed below the two pivot connections R1 and R1'.

The upper end portion of the standing leg 104D can be coupled with the end segment 124B of the frame subassembly 114 via a leg linkage 160, which is assembled with the coupling bracket 120 and can include three linking members 162A, 162B and 162C. The linking member 162A can be affixed with the frame subassembly 114 (in particular with the end segment 124B), and can have an ear 164 projecting eccentrically from the pivot connection R1. The linking member 162B can be connected with the ear 164 of the linking member 162A via a pivot connection R3. The linking member 162C can be affixed with the upper end portion of the standing leg 104D, and can be pivotally connected with the linking member 162B via a pivot connection R4 which is guided for sliding displacement along the guide slot 158.

Likewise, the upper end portion of the standing leg 104B can be coupled with the end segment 124D of the frame subassembly 116 via a leg linkage 166 that is assembled with the coupling bracket 120. The leg linkage 166 can be similar to the leg linkage 160 in structure, and can include three linking members 168A, 168B and 168C. The linking member 168A can be affixed with the frame subassembly 116 (in particular with the end segment 124D), and can have an ear 170 projecting eccentrically from the pivot connection R1'. The linking member 168B can be connected with the ear 170 of the linking member 168A via a pivot connection R3'. The linking member 168C can be affixed with the upper end portion of the standing leg 104B, and can be pivotally connected with the linking member 168B via a pivot connection R4' which is guided for sliding displacement along the guide slot 158'.

Like on the side 102A, the assembly of the two leg linkages 160 and 166, frame subassemblies 114 and 116, and standing legs 104D and 104B on the side 102B can have a symmetric geometry, the two leg linkages 160 and 166 forming a cross-shape. All of the pivot connections R1, R1', R2, R2', R3, R3', R4 and R4' can be achieved with any suitable parts such as pins or shaft portions, and can respectively define pivot axes that are parallel to one another along the direction D1. Moreover, the respective pivot axes defined by the pivot connections R1, R1', R2, R2', R3, R3', R4 and R4' on the side 102B of the upper frame assembly 102 can substantially match with the respective axes P1, P1', P2, P2', P3, P3', P4 and P4' on the side 102A of the upper frame assembly 102.

The playpen 100 as described herein thus has four leg linkages 146, 152, 160 and 166 disposed adjacent to the middles of the two opposite sides 102A and 102B, whereas the two other sides 102C and 102D and all the corner brackets 128A, 128B, 128C and 128D are free of leg linkages. With the four leg linkages 146, 152, 160 and 166, the upper frame assembly 102 and the four standing legs 104A, 104B, 104C and 104D can be linked in movement during folding and unfolding of the playpen 100. Moreover, the two frame subassemblies 114 and 116 can respectively form two cantilevers projecting oppositely from the two coupling brackets 118 and 120 when the playpen 100 is in an unfolded state.

Referring to FIGS. 1-7, when the playpen 100 is in the unfolded state for use, the pivot connections P3 and P4 in the leg linkage 146 are located at two sides of a vertical axis V intersecting the pivot connection P1. Moreover, the pivot connections P2, P3 and P4 define three distinct apexes of a triangle (shown with phantom lines in FIG. 6), the apex of the pivot connection P4 being located at an underside of a straight line L joining the respective apexes of the two pivot connections P2 and P3. In the unfolded state, the cantilever formed by the frame subassembly 114 can bias the leg linkage 146 to a geometric configuration that maintains the aforementioned relationship between the three apexes of the triangle defined by the three pivot connections P2, P3 and P4. More particularly, the cantilever of the frame subassembly 114 would tend to bias the pivot connection P3 upward and the pivot connection P4 downward in proximity to the lower end of the guide slot 144, which in turn can rotationally urge the linking member 148C and the standing leg 104C outward toward the unfolded state. In the same manner, the cantilever of the frame subassembly 114 can also bias the other leg linkage 160 coupled with the standing leg 104D on the side 102B to a similar geometric configuration of a triangle formed by the three pivot connections R2, R3 and R4 (better shown in FIG. 7).

Referring to FIGS. 6 and 7, the cantilever formed by the frame subassembly 116 can likewise bias the leg linkage 152 to a geometric configuration that keeps the apex of the pivot connection P4' at an underside of a straight line joining the respective apexes of the two pivot connections P2' and P3'. In a similar manner, the cantilever of the frame subassembly 116 also biases the leg linkage 166 coupled with the standing leg 104B on the other side 102B to a similar geometric configuration having a triangle formed by the three pivot connections R2', R3' and R4'.

The leg linkages 146, 152, 160 and 166 as described herein thus can assist in maintaining the standing legs 104A, 104B, 104C and 104D in the unfolded state without the need of latch mechanisms. Moreover, downward pressure applied on any of the frame subassemblies 114 and 116 would not fold the playpen 100, which can make it safer in use.

Figure 8:
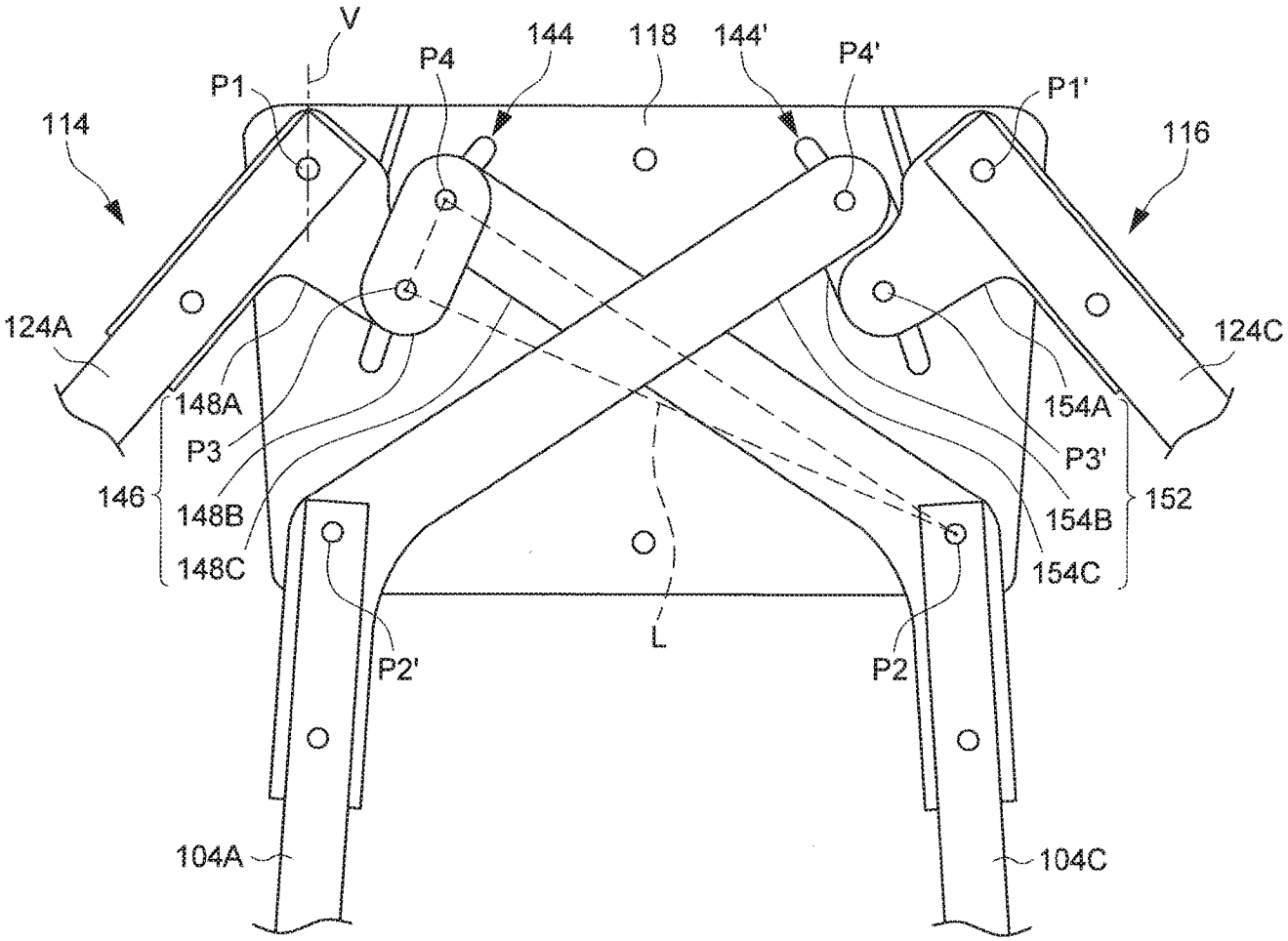
FIG. 8 is a schematic view illustrating the two leg linkages of FIG. 6 in a folded state.
Figure 9:
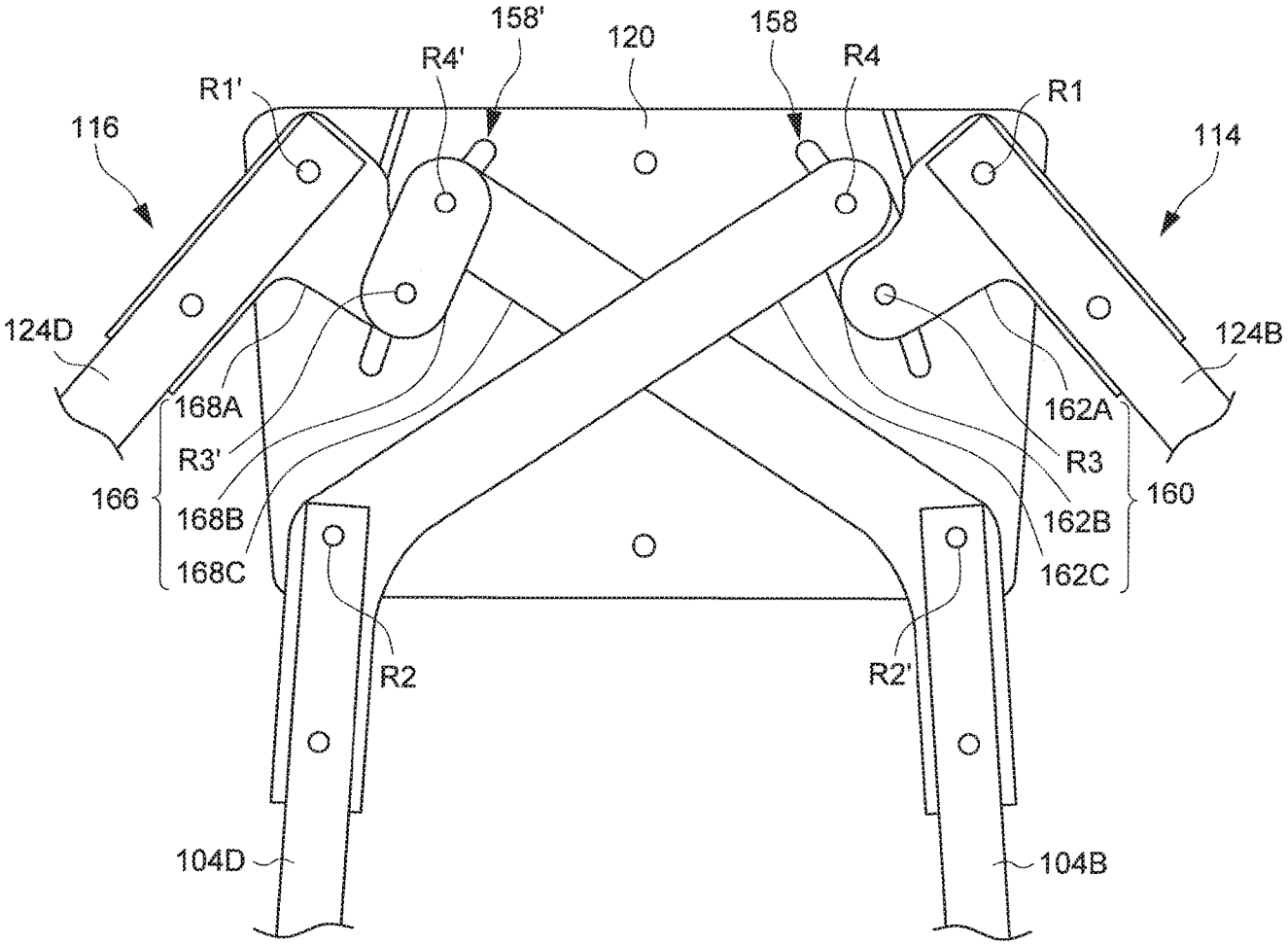
FIG. 9 is a schematic view illustrating the two leg linkages of FIG. 7 in a folded state.

FIGS. 8 and 9 schematically illustrate the leg linkages 146, 152, 160 and 166 in the folded state. For folding the playpen 100, a caregiver can push the two standing legs 104A and 104C (and/or 104B and 104D) toward each other, which respectively causes rotation of the linking members 154C and 148C (and 168C and 162C) about the respective axes of the pivot connections P2' and P2 (and R2' and R2) relative to the coupling bracket 118 (and 120) in a direction that respectively displaces the pivot connections P4' and P4 (and R4' and R4) upward along the guide slots 144' and 144 (and 158' and 158). This displacement of the pivot connections P4' and P4 (and R4' and R4) respectively causes sliding and rotation of the linking members 154B and 148B (and 168B and 162B), which in turn respectively drive the linking members 154A and 148A (and 168A and 162A) and the frame subassemblies 116 and 114 respectively affixed thereto to rotate about the pivot connections P1', R1' and P1, R1 to a folded state as shown in FIGS. 8 and 9. Once the folded state is reached, the pivot connections P2, P3 and P4 in the leg linkage 146 define three distinct apexes of a triangle, the apex of the pivot connection P4 being located above the line L joining the respective apexes of the two pivot connections P2 and P3. The pivot connections P2', P3' and P4' in the leg linkage 152, the pivot connections R2, R3 and R4 in the leg linkage leg linkage 160, and the pivot connections R2', R3' and R4' in the leg linkage 166 can respectively form similar geometric configurations when the playpen 100 is in the folded state.

Referring again to FIGS. 1-5, the foot members 112A, 112B, 112C and 112D can be respectively connected pivotally with the lower end portions of the standing legs 104A, 104B, 104C and 104D, so that each foot member can rotate relative to the standing leg coupled thereto during folding and unfolding of the playpen 100. As better shown in FIG. 5, the respective pivot axes T of the foot members 112A, 112B, 112C and 112D can be generally perpendicular to the two vertical end planes of the playpen 100 respectively corresponding to the two sides 102A and 102B of the upper frame assembly 102. Owing to the force applied through each of the bar segments 110A, 110B, 110C and 110D, each of the foot members 112A, 112B, 112C and 112D can respectively rotate about its pivot axis T slightly outward relative to the corresponding standing leg 104A, 104B, 104C and 104D in a direction B1 (shown in FIG. 4) when the playpen 100 is folded, and can respectively rotate slightly inward relative to corresponding standing leg 104A, 104B, 104C and 104D in a direction B2 (shown in FIG. 4) opposite to B1 when the playpen 100 is unfolded.

Figure 10:
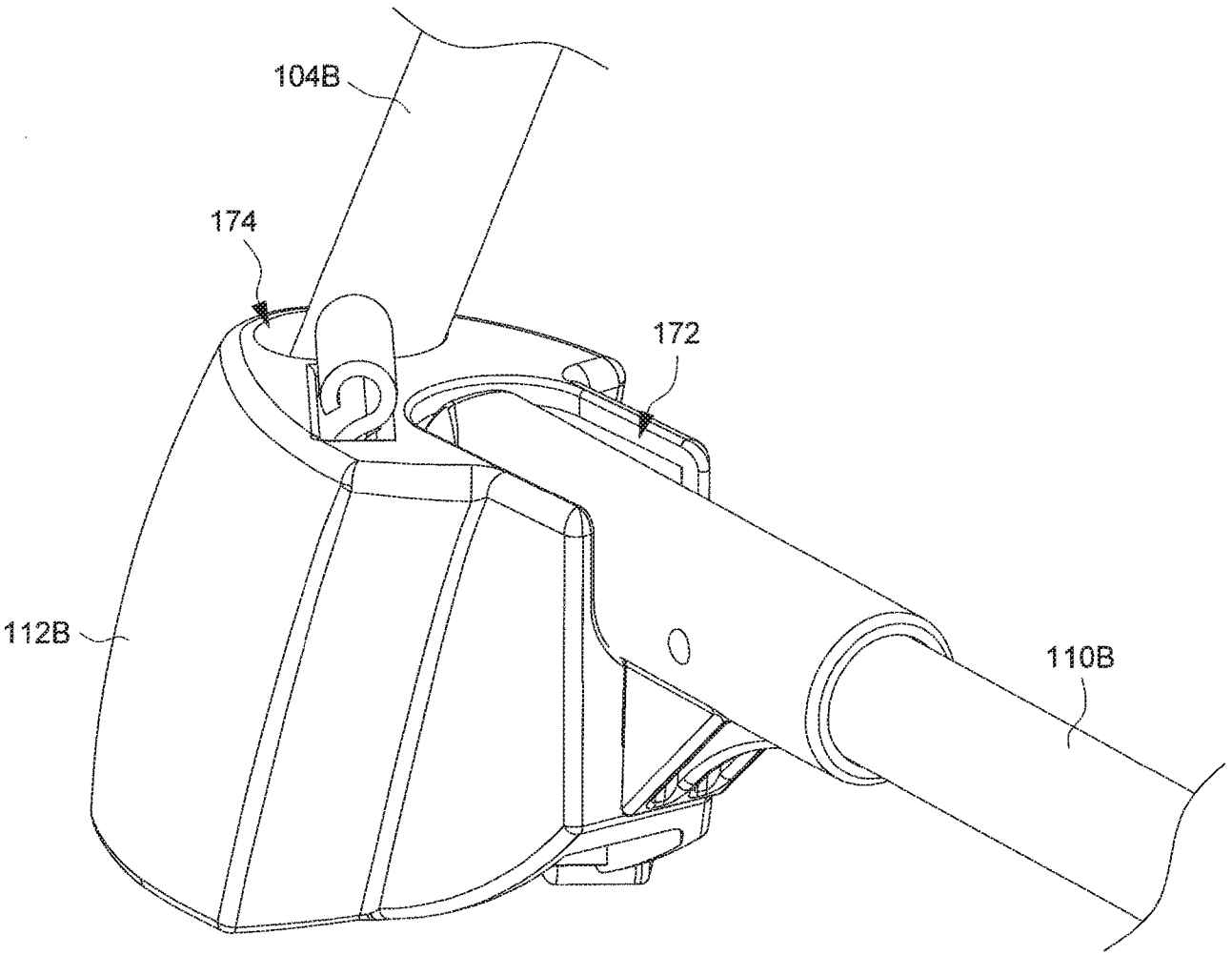
FIG. 10 is an enlarged view illustrating the assembly of one foot member with one standing leg and one bar segment in the frame structure shown in FIG. 2.
Figure 11:
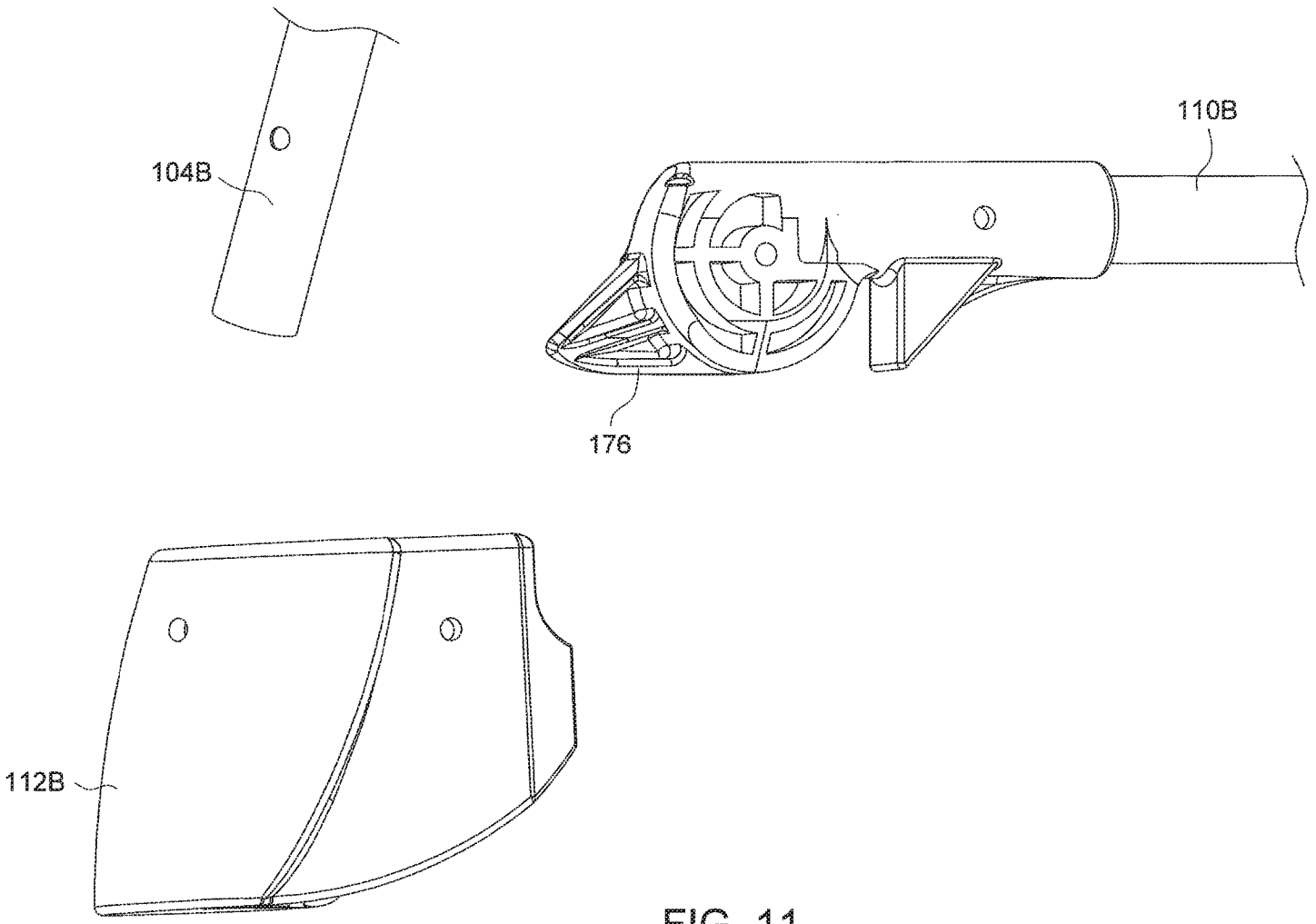
FIG. 11 is an exploded view illustrating the assembly of one foot member with one standing leg and one bar segment in the frame structure shown in FIG. 2.
Figure 12:
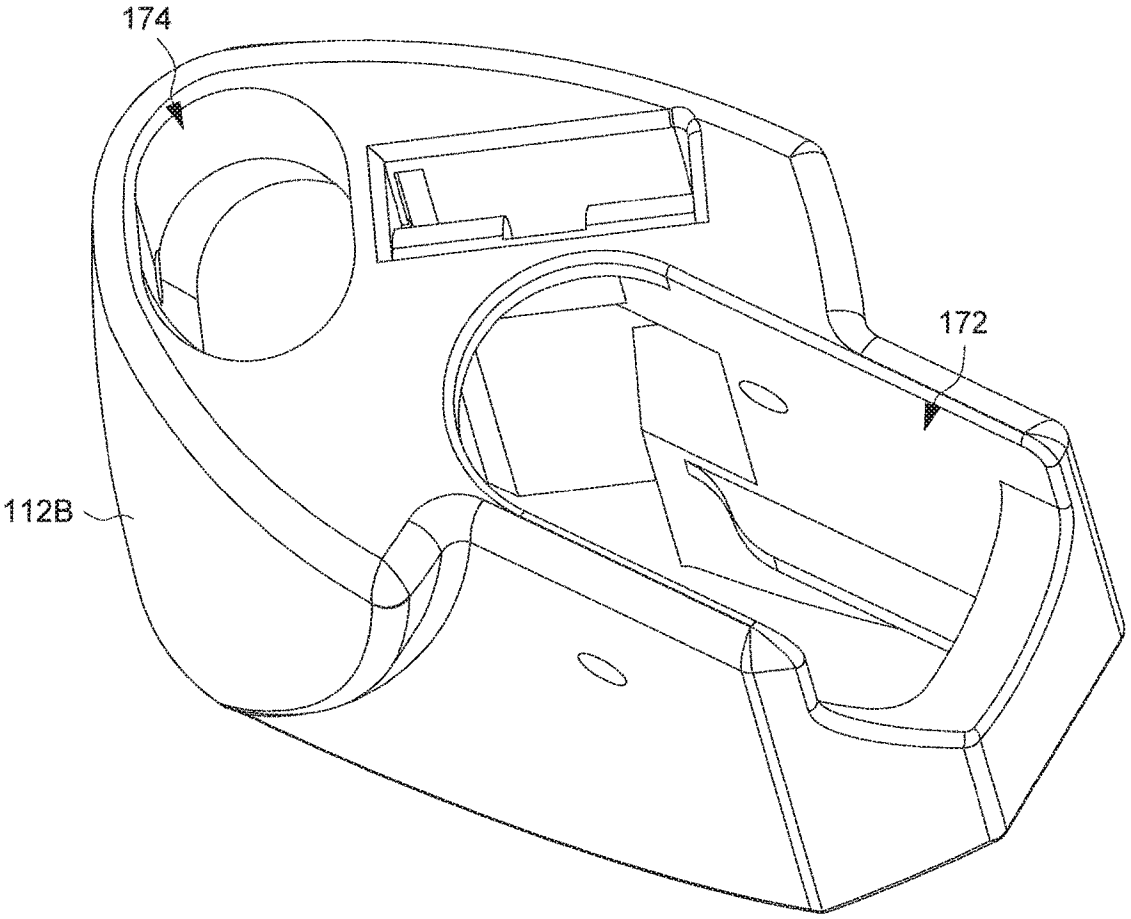
FIG. 12 is a schematic view illustrating the construction of one foot member.

In conjunction with FIG. 1-5, FIGS. 10 and 11 are respectively enlarged and exploded views illustrating the assembly of one of the foot members (e.g., foot member 112B) with one standing leg (e.g., standing leg 104B) and one bar segment (e.g., bar segment 110B), and FIG. 12 is a schematic view illustrating the construction of one foot member (e.g., foot member 112B). Referring to FIGS. 10-12, the foot member 112B can include a pocket 172 for receiving the pivotal connection of an end portion of the bar segment 110B, and another pocket 174 for receiving the pivotal connection of the lower end of the standing leg 104B. Moreover, the end portion of the bar segment 110B received in the pocket 172 can be affixed with an impeding protrusion 176 projecting radially with respect to the pivot axis about which the bar segment 110B can rotate relative to the foot member 112B.

Figure 13:
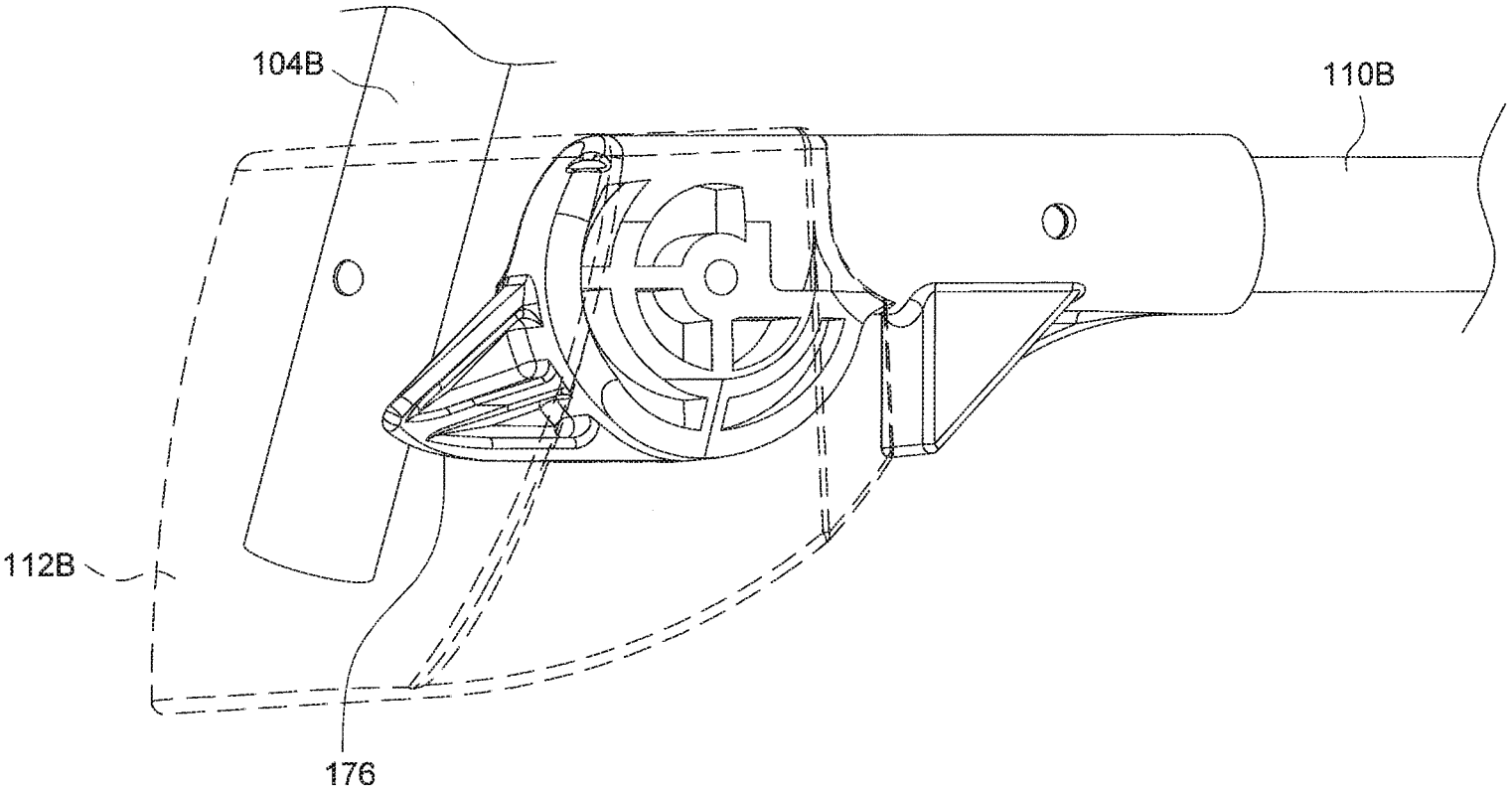
FIGS. 13 and 14 are schematic views illustrating exemplary operation of an impeding protrusion provided on a bar segment to lock a standing leg in an unfolded state.
Figure 14:
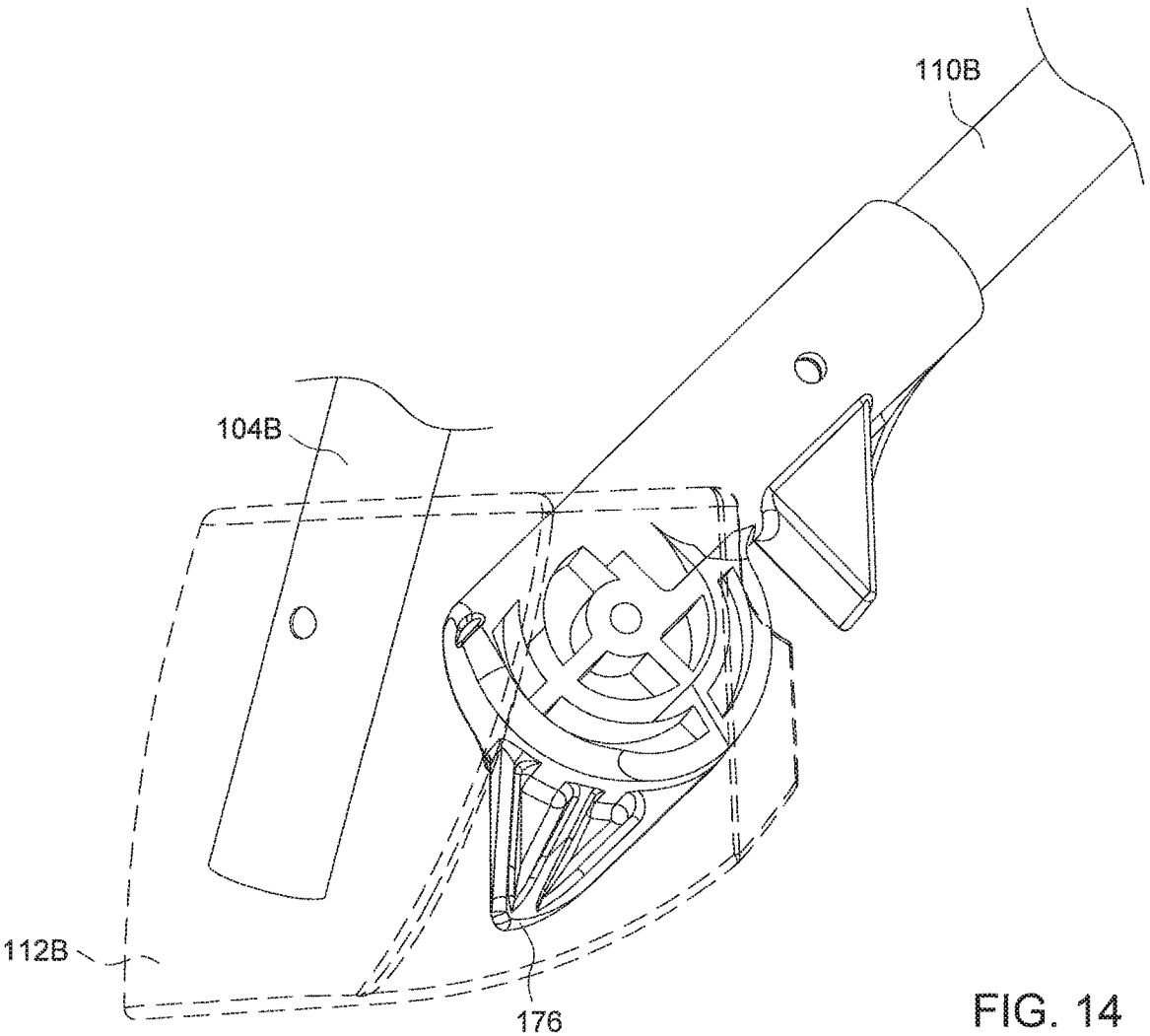
Figure 15:
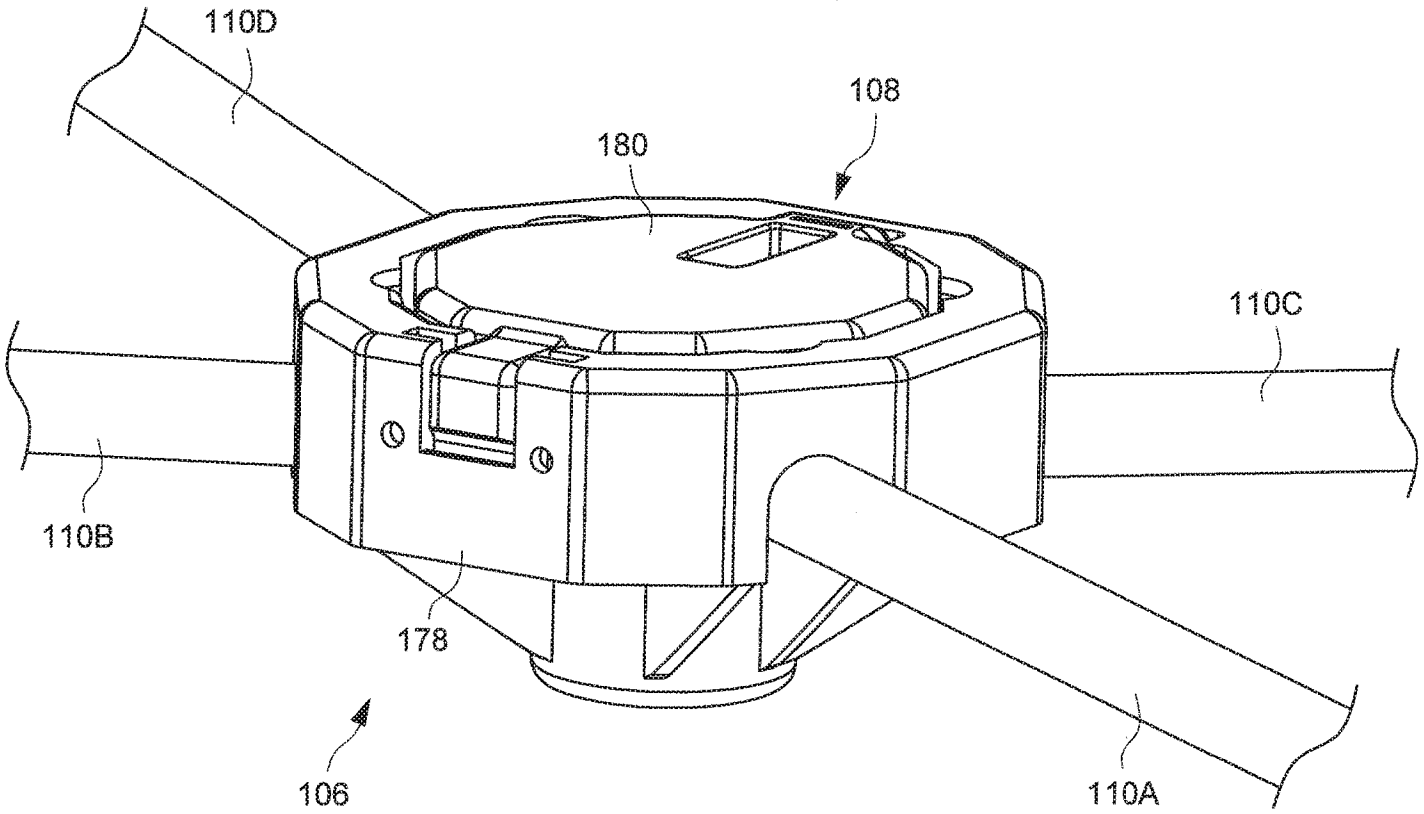
FIG. 15 is an enlarged view illustrating the construction of a central hub disposed at a center of a bottom linkage assembly in the frame structure shown in FIG. 2.

FIGS. 13 and 14 are schematic views illustrating exemplary operation of the impeding protrusion 176. For clarity, the foot member 112B is shown with phantom lines in FIGS. 13 and 14. Referring to FIG. 13, when the playpen 100 is in the unfolded state, the bar segment 110B may extend generally horizontal, and the impeding protrusion 176 of the bar segment 110B can be in a locking position engaged with the corresponding standing leg 104B, which can lock the standing leg 104B in place and prevent its rotation relative to the foot member 112B. Referring to FIG. 14, when the playpen 100 is folded, the impeding protrusion 176 can rotate along with the bar segment 110B relative to the foot member 112B to a release position disengaged from the standing leg 104B, which consequently allow outward rotation of the foot member 112B relative to the standing leg 104B.

While FIGS. 10-14 only describe exemplary assembly and operation for the foot member 112B and the standing leg 104B and bar segment 110B coupled thereto, it will be appreciated that the other foot members 112A, 112C and 112D, standing legs 104A, 104C and 104D, and bar segments 110A, 110C and 110D can be provided with the same features shown in FIGS. 10-14.

In conjunction with FIGS. 2-5, FIGS. 15 and 16 are respectively enlarged perspective and cross-sectional views illustrating the construction of the central hub 108 disposed at the center of the bottom linkage assembly 106. Referring to FIGS. 2-5, 15 and 16, the central hub 108 can include a hub housing 178, a handle 180, a latch 182, a spring 184 and a lever 186. The hub housing 178 can be respectively connected pivotally with end portions of the bar segments 110A, 110B, 110C and 110D, which can be received at least partially in an interior of the hub housing 178. The bar segments 110A, 110B, 110C and 110D can rotate relative to the hub housing 178 between an unfolded configuration lying substantially horizontal (better shown in FIGS. 2-5 and 15) corresponding to the unfolded state of the playpen 100, and a folded configuration (better shown in FIG. 17) corresponding to the folded state of the playpen 100.

The handle 180 can be pivotally connected with the hub housing 178 via a pivot connection C1, and can have an inner side provided with a guide slot 188. In one embodiment, the handle 180 can be formed as a cover that can be operable to open and close at least partially an upper opening 178A of the hub housing 178.

The latch 182 is assembled with the hub housing 178 for sliding movement along a vertical displacement axis W. For example, the hub housing 178 may be affixed with a shaft portion 190, and the latch 182 can be guided for sliding displacement along the shaft portion 190. The latch 182 can contact with the end portions E of the bar segments 110A, 110B, 110C and 110D at an upper side thereof to keep the bar segments in an unfolded state. The spring 184 can be assembled around the shaft portion 190, and can have two opposite ends respectively connected with the latch 182 and the hub housing 178. The spring 184 can bias the latch 182 upward so as to keep the latch 182 in contact with the lever 186.

The lever 186 can be disposed in sliding contact with the latch 182, and can be respectively connected pivotally with the hub housing 178 and the handle 180 via two pivot connections C2 and C3 spaced apart from each other. The pivot connection C3 is guided for sliding displacement along the guide slot 188 of the handle 180. In one embodiment, the pivot connection C2 can be supported by the shaft portion 190. All of the pivot connections C1, C2 and C3 can be constructed with elements such as pins or shaft portions, and can define parallel pivot axes that extend in a generally horizontal plane.

Figure 16:
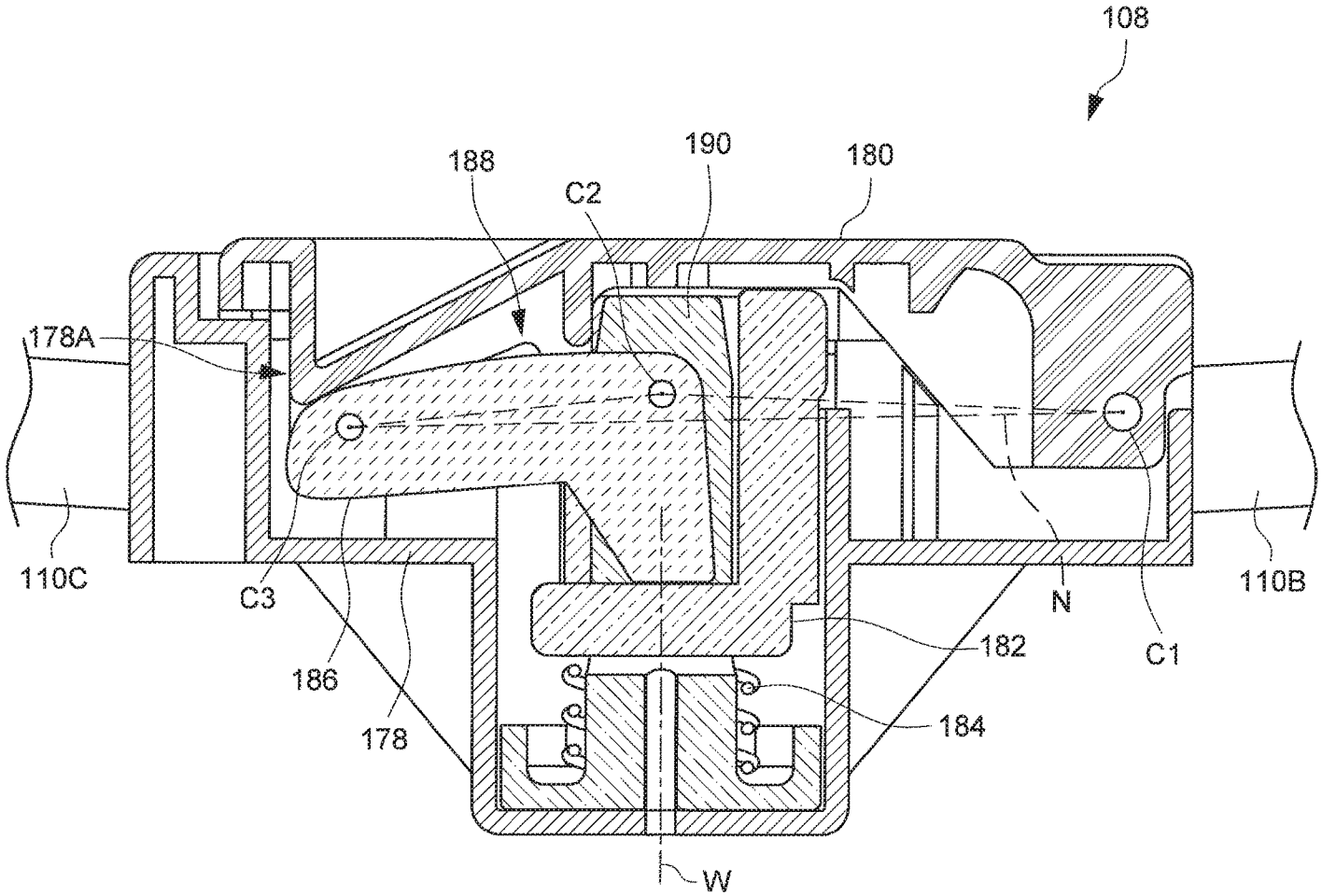
FIG. 16 is a cross-sectional view illustrating the construction of a central hub disposed at a center of a bottom linkage assembly in the frame structure shown in FIG. 2.

In FIG. 16, the central hub 108 is shown in a configuration corresponding to the unfolded state of the playpen 100. In this configuration, the handle 180 can close the upper opening 178A of the hub housing 178. Moreover, the pivot connections C1, C2 and C3 can respectively define three distinct apexes of a triangle, and the pivot connection C2 can be located in a region between the two pivot connections C1 and C3. In this configuration state, the lever 186 can be rotationally biased by the action of the spring 184 transmitted via the contact between the latch 182 and the lever 186 to a configuration where the apex of the pivot connection C2 is maintained above a line N joining the respective apexes of the two pivot connections C1 and C3. As shown, the contact between the lever 186 and the latch 182 can occur below the line N. As a result, the spring-biased lever 186 can urge the handle 180 downward for closing the hub housing 178, which in turn can counteract against the spring 184 and retain the latch 182 in a retracted position for locking the bar segments 110A, 110B, 110C and 110D in the unfolded configuration. Owing to the aforementioned closed-loop interaction between the handle 180, latch 182, spring 184 and lever 186, the central hub 108 can self-maintain a locking state, and cannot be unlocked by forcing the bar segments 110A, 110B, 110C and 110D to rotate in a folding direction. As a result, the bottom linkage assembly 106 can be safer during use.

Figure 17:
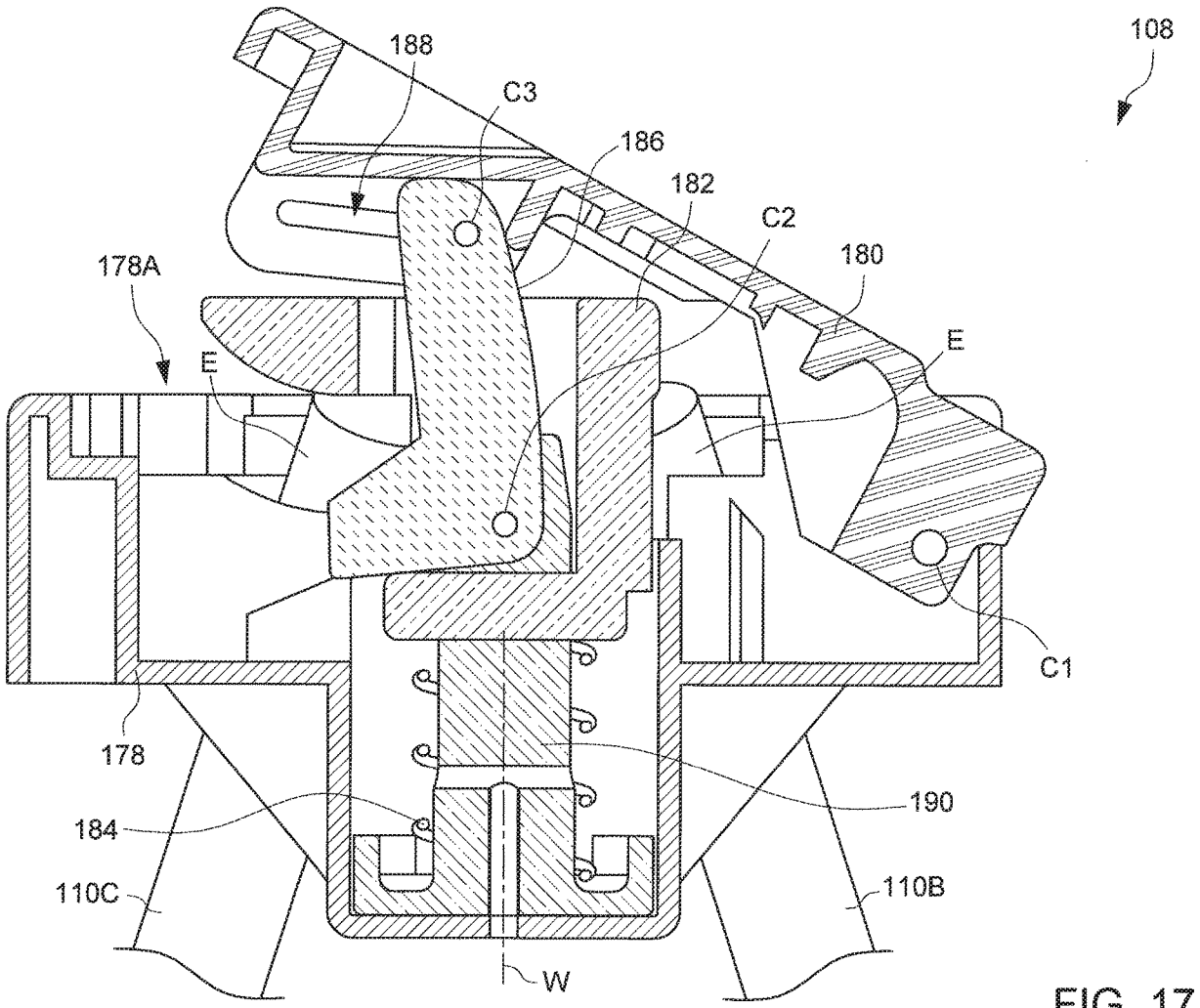
FIG. 17 is a cross-sectional view illustrating the central hub of FIG. 16 in an unlocked configuration corresponding to a folded state of the playpen shown in FIG. 1.

FIG. 17 is a schematic view illustrating the central hub 108 in a configuration corresponding to a folded state of the playpen 100. For folding the playpen 100, a caregiver can pull the handle 180 upward to open the upper opening 178A of the hub housing 178. As a result, the handle 180 rotates relative to the hub housing 178 about the pivot connection C1, which urges the lever 186 to rotate relative to the hub housing 178 about the pivot connection C2 for raising the pivot connection C3. Meanwhile, the latch 182 biased by the spring 184 can slide upward to protrude outward from the upper opening 178A of the hub housing 178 and leave room for folding rotation of the bar segments 110A, 110B, 110C and 110D. The central hub 108 is thereby unlocked, and the caregiver can further pull the entire central hub 108 upward to drive folding rotation of the bar segments 110A, 110B, 110C and 110D relative to the hub housing 178.

The playpen 100 as described herein can be easily folded and unfolded. For folding the playpen 100, a caregiver can operate the release buttons 132 and 138 to unlock the hinges 126 and 134 of the frame subassemblies 114 and 116, and then pull the handle 180 upward to unlock the central hub 108 of the bottom linkage assembly 106. Alternatively, the handle 180 may be first operated to unlock the central hub 108 of the bottom linkage assembly 106, and then the release buttons 132 and 138 may be pressed to unlock the hinges 126 and 134 of the frame subassemblies 114 and 116. Once the hinges 126 and 134 and the central hub 108 are unlocked, the caregiver can pull the central hub 108 upward to drive folding rotation of the bar segments 110A, 110B, 110C and 110D relative to the hub housing 178. The folding rotation of the bar segments 110A, 110B, 110C and 110D can drive folding of the standing legs 104A, 104B, 104C and 104D, which rotate relative to the coupling brackets 118 and 120 toward the folded state as shown in FIGS. 8 and 9 and cause folding of the frame subassemblies 114 and 116. The playpen 100 can be thereby collapsed to a compact size with reduced length and width dimensions.

For unfolding the playpen 100, the central hub 108 can be moved downward to drive unfolding rotation of the bar segments 110A, 110B, 110C and 110D relative to the hub housing 178. This unfolding rotation of the bar segments 110A, 110B, 110C and 110D can drive unfolding of the standing legs 104A, 104B, 104C and 104D, which rotate relative to the coupling brackets 118 and 120 toward the unfolded state shown in FIGS. 6 and 7 and cause unfolding of the frame subassemblies 114 and 116.

Advantages of the playpen 100 described herein include a frame geometry that can provide strength and stability, and allow wider side areas of the enclosure free of frame obstruction. Moreover, the frame structure of the playpen has a reduced number of latches, and the folding operation of the central hub 108 and hinges 126, 134 is not limited to a specific sequence, which can simplify the folding and unfolding operations.

Realizations of the playpen have been described in the context of particular embodiments. These embodiments are meant to be illustrative and not limiting. Many variations, modifications, additions, and improvements are possible. These and other variations, modifications, additions, and improvements may fall within the scope of the inventions as defined in the claims that follow.

What is claimed is:

1. A collapsible playpen comprising:

an upper frame assembly having four sides, the four sides including a first and a second side opposite to each other that respectively have a first and a second coupling bracket, and a third and a fourth side opposite to each other that are respectively contiguous to the first and second sides;

four standing legs having lower end portions respectively provided with a plurality of foot members, the lower end portions of the four standing legs being respectively connected pivotally with the foot members, the four standing legs including a first and a second standing leg respectively coupled with the upper frame assembly via a first and a second leg linkage that are assembled with the first coupling bracket, and a third and a fourth standing leg respectively coupled with the upper frame assembly via a third and a fourth leg linkage that are assembled with the second coupling bracket; and a bottom linkage assembly connected with the foot members of the four standing legs, the bottom linkage assembly including a central hub, and four bar segments that are coupled with the central hub and are respectively connected pivotally with the foot members of the four standing legs;

wherein the one of the four bar segments that is coupled with the first standing leg has an impeding protrusion, the impeding protrusion being movable along with the bar segment between a locking position engaged with the first standing leg and a release position disengaged from the first standing leg, the impeding protrusion being in the locking position for preventing relative rotation between the first standing leg and the foot member coupled therewith when the playpen is in an unfolded state.

2. The playpen according to claim 1, wherein the third and fourth sides of the upper frame assembly are free of leg linkages.

3. The playpen according to claim 1, wherein the first and second coupling brackets are respectively disposed at a middle of the first and second side of the upper frame assembly.

4. The playpen according to claim 1, wherein the upper frame assembly includes a first and a second frame subassembly each of which has two opposite ends respectively connected with the first and second coupling brackets, each of the first and second frame subassemblies forming a cantilever projecting from the first and second coupling brackets when the playpen is in the unfolded state.

5. The playpen according to claim 4, wherein at least one of the first and second frame subassemblies includes two side segments coupled with each other via a hinge, and two end segments respectively coupled with the two side segments via two corner brackets, the two end segments being further respectively coupled with the first and second coupling brackets.

6. The playpen according to claim 4, wherein the first and second leg linkages respectively include a plurality of first and second linking members that are assembled according to a cross-shaped geometry, the first leg linkage coupling the first frame subassembly with the first standing leg, and the second leg linkage coupling the second frame subassembly with the second standing leg.

7. The playpen according to claim 4, wherein the first coupling bracket includes a guide slot and is respectively connected with the first frame subassembly and the first standing leg via a first and a second pivot connection, and the first leg linkage includes:

a first linking member affixed with the first frame subassembly;

a second linking member connected with the first linking member via a third pivot connection; and a third linking member affixed with the first standing leg and connected with the second linking member via a fourth pivot connection, the fourth pivot connection being guided for sliding movement along the guide slot of the first coupling bracket.

8. The playpen according to claim 7, wherein when the playpen is in the unfolded state, the third and fourth pivot connections are located at two sides of a vertical axis intersecting the first pivot connection.

9. The playpen according to claim 7, wherein when the playpen is in the unfolded state, the second, third and fourth pivot connections define three distinct apexes of a triangle, the apex of the fourth pivot connection being located at an underside of a line joining the respective apexes of the second and third pivot connections.

10. The playpen according to claim 1, wherein each of the four bar segments has an end portion, and the central hub includes:

a hub housing respectively connected pivotally with the four bar segments, the end portions of the bar segments being received at least partially in the hub housing;

a handle having a guide slot and pivotally connected with the hub housing via a fifth pivot connection;

a latch assembled with the hub housing for sliding movement along a displacement axis, the latch contacting with the end portions of the bar segments at an upper side thereof to keep the bar segments in an unfolded configuration corresponding to the unfolded state of the playpen; and a lever in sliding contact with the latch, the lever being respectively connected pivotally with the hub housing and the handle via a sixth and a seventh pivot connection, the seventh pivot connection being guided for sliding displacement along the guide slot of the handle.

11. The playpen according to claim 10, wherein the handle closes an upper opening of the hub housing when the playpen is in the unfolded state.

12. The playpen according to claim 10, wherein the hub housing is affixed with a shaft portion, and the latch is guided for sliding displacement along the shaft portion.

13. The playpen according to claim 12, wherein the lever is pivotally connected with the shaft portion.

14. The playpen according to claim 10, wherein when the playpen is in the unfolded state, the fifth, sixth and seventh pivot connections define three distinct apexes of a triangle, the apex of the sixth pivot connection being located above a line joining the respective apexes of the fifth and seventh pivot connections.

15. The playpen according to claim 14, wherein the latch is connected with a spring, the lever being rotated by the latch biased by an action of the spring in a direction for keeping the apex of the sixth pivot connection above the line joining the respective apexes of the fifth and seventh pivot connections when the playpen is in the unfolded state, whereby locking the four bar segments in a horizontal configuration.

16. A playpen comprising:

an upper frame assembly including a first and a second frame subassembly that are respectively connected with a first and a second coupling bracket, the first frame subassembly having a first and a second end opposite to each other, and the second frame subassembly having a third and a fourth end opposite to each other;

four standing legs having lower ends respectively provided with foot members, the four standing legs including a first and a second standing leg respectively coupled with the first end of the first frame subassembly and the third end of the second frame subassembly via a first and a second leg linkage that are assembled with the first coupling bracket, and a third and a fourth standing leg respectively coupled with the second end of the first frame subassembly and the fourth end of the second frame subassembly via a third and a fourth leg linkage that are assembled with the second coupling bracket; and a bottom linkage assembly respectively connected with the foot members of the four standing legs;

wherein the first coupling bracket is respectively connected with the first frame subassembly via a first pivot connection and with the first standing leg via a second pivot connection, and the first leg linkage includes a first linking member, a second linking member and a third linking member, the first linking member being affixed with the first frame subassembly, the second linking member being connected with the first linking member via a third pivot connection, and the third linking member being affixed with the first standing leg and connected with the second linking member via a fourth pivot connection;

wherein when the playpen stands in an unfolded state, the third and fourth pivot connections are positioned higher than the second pivot connection, and the first and second frame subassemblies form two cantilevers oppositely projecting from the first and second coupling brackets so as to respectively bias each of the first through fourth leg linkages to a geometric configuration for maintaining the unfolded state.

17. The playpen according to claim 16, wherein the first frame subassembly includes two side segments coupled with each other via a hinge, and two end segments respectively coupled with the two side segments via two corner brackets, the two end segments being further respectively coupled with the first and third leg linkages.

18. The playpen according to claim 16, wherein the first and second leg linkages are assembled according to a cross-shaped geometry.

19. The playpen according to claim 16, wherein the first coupling bracket includes a guide slot, and the fourth pivot connection is guided for sliding movement along the guide slot of the first coupling bracket.

20. The playpen according to claim 16, wherein the second frame subassembly and the second standing leg are respectively connected pivotally with the first coupling bracket, the second frame subassembly and the second standing leg being coupled with each other via three other linking members that are assembled symmetrically to the first through third linking members.

21. The playpen according to claim 16, wherein when the playpen stands in the unfolded state, the second, third and fourth pivot connections define three distinct apexes of a triangle, the apex of the fourth pivot connection being located at an underside of a line joining the respective apexes of the second and third pivot connections.

22. A playpen comprising:

a plurality of standing legs coupled with an upper frame assembly via a plurality of leg linkage assemblies; and a bottom linkage assembly connected with a plurality of foot members respectively provided at lower ends of the standing legs, wherein the bottom linkage assembly includes:

a plurality of bar segments respectively connected pivotally with the foot members of the standing legs;

a hub housing respectively connected pivotally with the bar segments, the bar segments having end portions received at least partially in the hub housing, the bar segments being rotatable relative to the hub housing between a folded and an unfolded configuration;

a handle having a guide slot and pivotally connected with the hub housing via a first pivot connection;

a latch assembled with the hub housing for sliding movement, the latch contacting with the end portions of the bar segments at an upper side thereof to maintain the bar segments in the unfolded configuration; and a lever connected with the latch, the lever further being respectively connected pivotally with the hub housing and the handle via a second and a third pivot connection, the third pivot connection being guided for sliding displacement along the guide slot of the handle.

23. The playpen according to claim 22, wherein when the playpen is unfolded for use, the first through third pivot connections define three distinct apexes of a triangle, the apex of the second pivot connection being located above a line joining the respective apexes of the first and third pivot connections.

24. The playpen according to claim 23, wherein when the playpen is unfolded for use, the lever contacts with the latch at a location below the line joining the respective apexes of the first and third pivot connections.

25. The playpen according to claim 24, wherein the latch is connected with a spring, and when the playpen is unfolded, the lever is rotationally biased by an action of the spring in a direction for keeping the apex of the second pivot connection above the line joining the respective apexes of the first and third pivot connections.

26. The playpen according to claim 22, wherein the handle closes an upper opening of the hub housing when the bar segments are in the unfolded configuration.

27. The playpen according to claim 22, wherein the hub housing is affixed with a shaft portion, and the latch is guided for sliding displacement along the shaft portion.

28. The playpen according to claim 27, wherein the lever is pivotally connected with the shaft portion.

* * * * *